US005765825A

United States Patent [19]

Watase

[11] Patent Number: 5,765,825

[45] Date of Patent: Jun. 16, 1998

[54] IMAGE FORMING APPARATUS WITH A LARGE CAPACITY PAPER FEEDING UNIT HAVING A DETACHABLE PAPER FEEDING GUIDE

[75] Inventor: Hiroyuki Watase, Yokohama, Japan

[73] Assignee: Ricoh Company, Ltd., Tokyo, Japan

[21] Appl. No.: 612,507

[22] Filed: Mar. 8, 1996

[30] Foreign Application Priority Data

Mar. 14, 1995 [JP] Japan ..... 7-054731

[51] Int. Cl.[6] ..... B65H 3/44; B65H 5/02

[52] U.S. Cl. ..... 271/9.13; 271/162; 271/273

[58] Field of Search ..... 271/9.11, 9.13, 271/162, 164, 273, 274, 272

[56] References Cited

U.S. PATENT DOCUMENTS

| | | | |
|---|---|---|---|
| 4,165,069 | 8/1979 | Colglazier et al. | 271/162 |
| 5,085,422 | 2/1992 | Sagara | 271/162 |
| 5,280,898 | 1/1994 | Nakano et al. | 271/9.11 |

FOREIGN PATENT DOCUMENTS

| | | | |
|---|---|---|---|
| 258030 | 12/1985 | Japan | 271/273 |
| 216925 | 9/1991 | Japan | 271/162 |
| 107345 | 4/1994 | Japan | 271/9.13 |

*Primary Examiner*—Boris Milef

*Attorney, Agent, or Firm*—Oblon, Spivak, McClelland, Maier & Neustadt, P.C.

[57] ABSTRACT

An image forming apparatus, which includes a pair of vertical paper feeding guides of a vertical paper path, one guide being fixed to a main body of the apparatus as a fixed guide and the other guide being held for movement relative to the main body as a movable guide. Both of the movable guide and the large capacity paper feeding unit are able to swing open and close relative to the main body around shafts provided parallel to the direction of vertical paper feeding at one end of each of the guide and the large capacity paper feeding unit. The provision of an improved image forming apparatus realizes capabilities of faster and more secured paper feeding and easier parts replacement.

20 Claims, 4 Drawing Sheets

IMAGE FORMING APPARATUS WITH A LARGE CAPACITY PAPER FEEDING UNIT HAVING A DETACHABLE PAPER FEEDING GUIDE

BACKGROUND OF THE INVENTION

1. Field of the Invention

The present invention generally relates to an image forming apparatus, and more particularly to a large capacity paper feeding unit having a detachable paper feeding guide for use in an image forming apparatus, such as a reproduction machine, a printer or the like.

2. Description of the Background

As customers demand faster speed and more functions, image forming apparatus in recent years have been provided with a large capacity paper feeding unit in addition to a plurality of paper feeding cassettes in order to avoid frequent replenishment of copy papers. Generally, the plurality of paper feeding cassettes are placed beneath an image forming unit in the main body of the apparatus and the large capacity paper feeding unit is placed along one side of the cassettes, outside of the main body of the apparatus, and a vertical paper path for feeding papers vertically up to the image forming unit from the cassettes is provided between the tips of the cassettes and the large capacity paper feeding unit.

Such a vertical paper path is generally provided with two paper feeding guides through which papers are fed, one guide being provided in the main body of the apparatus along the tips of the cassettes and the other guide being fixed to the large capacity paper feeding unit. Further, there is such a large capacity paper feeding unit whose side plate serves as one of the vertical paper feeding guides as disclosed in Japanese Laid-Open Patent Application Tokukaihei 4-317930.

Further, the large capacity paper feeding unit is generally held to move to open and close relative to the main body of the apparatus around a shaft located on the back side thereof for providing access to the paper path.

In an image forming apparatus having such a large capacity paper feeding unit having an integrated or fixed paper feeding guide as mentioned above, there is a problem that even a small distortion of the large capacity paper feeding unit causes the vertical paper feeding guide on the side of the large capacity paper feeding unit to be out of alignment with the guide which is provided on the part of the main body, resulting in skew of papers fed through the vertical paper feeding guides. Also, there is a considerable limitation in positioning the large capacity paper feeding unit, because the unit is required to be positioned correctly relative to the vertical paper path. In addition, whenever the design of the vertical paper path of the apparatus is changed, another large capacity paper feeding unit has to be prepared accordingly. Moreover, it takes a long time to replace a part, such as a paper jam sensor which is attached to the vertical paper feeding guide, because it is required to dismantle the vertical paper guide to replace the sensor.

In view of the above problems encountered in the background available image forming apparatus, it is highly desirable to provide an image forming apparatus equipped with a large capacity paper feeding unit with an improved vertical paper feeding guide, capable of secured paper feeding and easier parts replacement.

SUMMARY OF THE INVENTION

Accordingly, one object of the present invention is to provide a novel image forming apparatus which overcomes the drawbacks in the background devices.

In accordance with the object of the present invention, an image forming apparatus is provided with a pair of vertical paper feeding guides, one guide being fixed to the main body of an image forming apparatus as a fixed guide and the other guide being held to move to open and close relative to the main body as a movable guide, and with a large capacity paper feeding unit which is also held to move to open and close relative to the main body. The movable guide and the large capacity paper feeding unit are able to swing to open and close together around shafts provided parallel to the direction of vertical paper feeding at one end of each of the movable guide and the large capacity paper feeding unit at a rear side of the main body.

In accordance with another aspect of the present invention, an elastic member is also provided mounted between the large capacity paper feeding unit and the movable guide to press the movable guide towards the fixed guide, and a spacer is also provided mounted on the movable guide to keep a predetermined distance between the movable guide and the fixed guide.

In accordance with yet another aspect of the present invention, a locking mechanism is provided to lock the large capacity paper feeding unit at a closed position, a sensor device to detect the paper feeding unit at the closed position and an elastic member equipped between the paper feeding unit and the movable guide to thrust the paper feeding unit away from the main body of the apparatus around the shaft to a position that the sensor device does not detect the large capacity paper feeding unit.

In accordance with another aspect of the present invention, a plurality of shafts are provided on a back side of the main body, and a joint mechanism which realizes a linkage between the movable guide and the large capacity paper feeding unit and enables to swing the movable guide and the feeding unit together with a single operation around the shafts maintaining approximately the same opening angle towards the main body is also provided. The joint mechanism includes a guide member having a guide slit and attached to the large capacity paper feeding unit and a linking member which is fixed to the movable guide at one end and which slidably fits into the guide slit of the guide member with a cylinder part which is provided at the other end. The linking member may be disconnected from the movable guide by detaching a screw. Further, the cylinder part is made of materials of reduced friction or the surface thereof is processed to be slippery, so that both of the large capacity paper feeding unit and the movable guide are moved to close and open with ease even after connected by the joint mechanism.

The provision of an improved image forming apparatus in the present invention realizes a capability of more secured paper feeding and easier parts replacement.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The present invention will now be described in detail with respect to the accompanying drawings.

Figure 1:
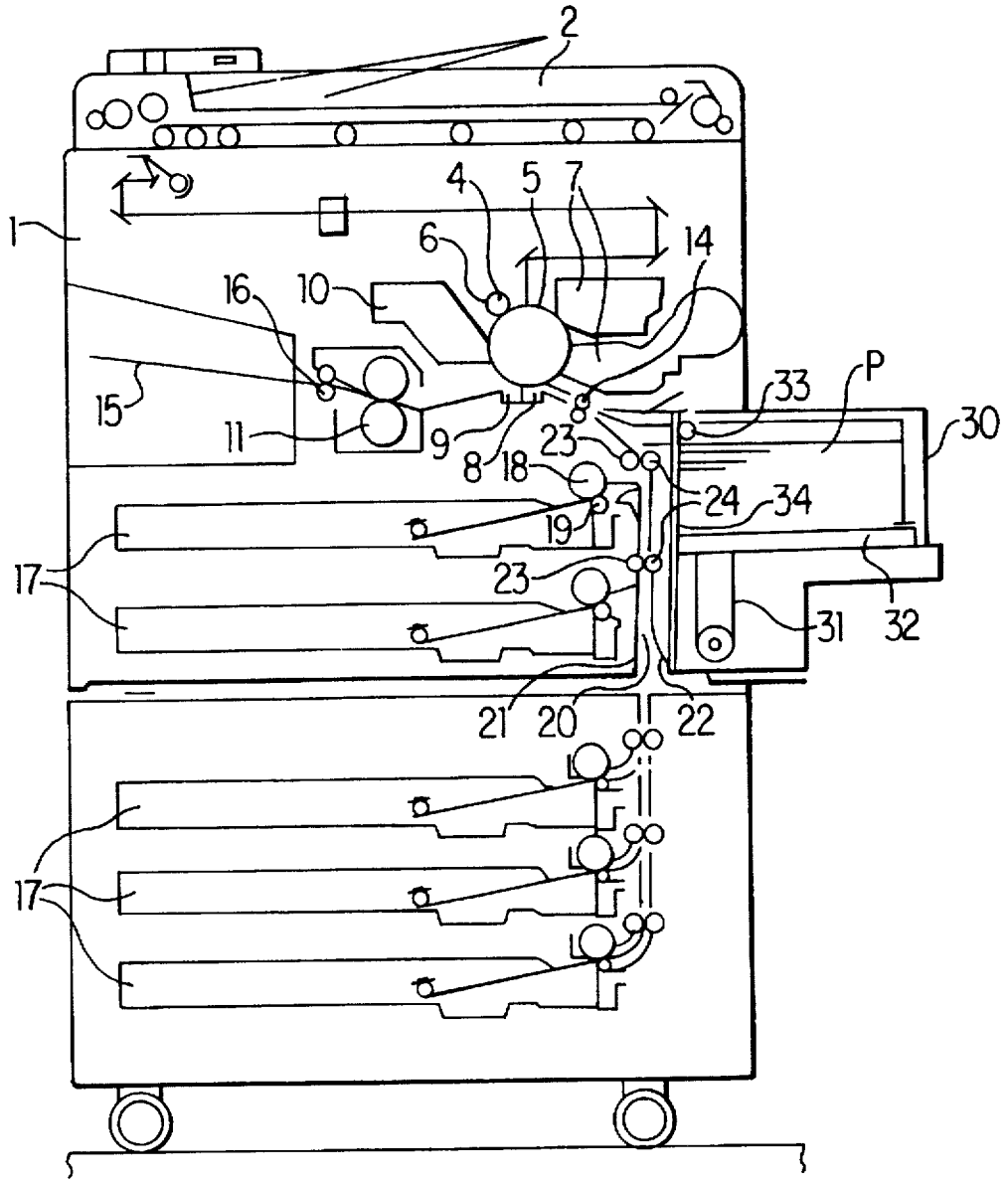
FIG. 1 is a schematic view showing an example of an image forming apparatus related to this invention.

FIG. 1 illustrates an image forming apparatus related to the present invention.

A main body 1 of the image forming apparatus includes a document reading unit 2 which reads contents of documents optically, and an image forming unit 4. The image forming unit 4 includes a photoconductor 5 held for rotation, a charging unit 6 which serves to charge the photoconductor 5 by applying a high voltage thereto, a developer 7 which develops a latent image on the photoconductor 5 formed by the above-mentioned document reader 2, a transfer charger 8 which transfers the image developed on the photoconductor 5 to a copy paper, a separating charger 9 which separates a paper from the photoconductor 5, a cleaning unit 10 which cleans the surface of the photoconductor 5, and a fixing unit 11 which fixes the image transferred on the copy paper. Beneath the image forming unit 4 in the main body 1 of the image forming apparatus, a plurality of paper feeding cassettes 17 are stacked with a certain spacing. A feeding roller 18 and a separation roller 19 are held for rotation in contact with each other at the tip of each paper feeding cassette 17.

When image formation is started, the photoconductor 5 rotates in a clockwise direction, and the surface of the photoconductor 5 is electrostatically charged by the charging unit 6, and a latent image is formed on the charged area by light exposure with the document reading unit 2. This latent image is developed into a toner image by the developer 7, and subsequently moves to the transfer section. On the other hand, a paper is fed from the feeding cassette 17 to the transfer section through a pair of registration rollers 14 synchronized with the movement of the toner image, and the toner image is transferred to the paper by the transfer charger 8. The paper on which the toner image is formed is separated from the photoconductor 5 by the separating charger 9, and then passes through the fixing unit 11 wherein the toner image is fixed thereon. After the toner image is fixed, the paper is discharged to a paper receiving tray 15 by a discharging roller 16. Following the transfer, the remaining toner on the photoconductor 5 is removed with the cleaning unit 10, and the photoconductor 5 is ready for the next copying cycle.

Figure 2:
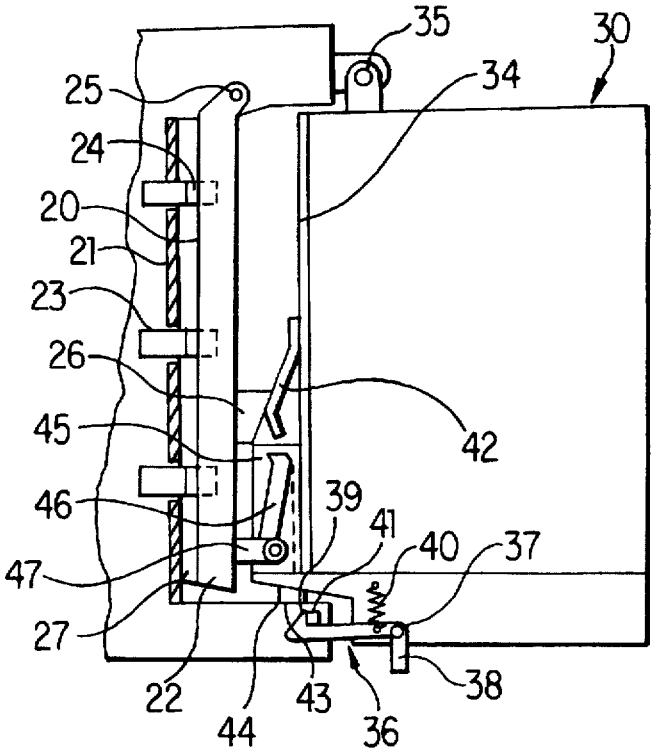
FIG. 2 is a top view of a large capacity paper feeding unit and a movable guide of the image forming apparatus at a closed position.

A vertical paper path 20, through which copy papers are fed, is provided along the tip portions of the cassettes 17. The vertical paper path 20 has a pair of vertical paper feeding guides 21 and 22, and a pair of feeding rollers 23 and 24. A large capacity paper feeding unit 30 is placed adjacent to the vertical paper path 20 as shown in FIGS. 1 and 2. The large capacity paper feeding unit 30 includes an elevator rack 32 which is driven by a belt 31, and a paper feeding roller 33 which is in contact with a paper P on the rack 32, and a control plate 34 which straightens the edge lines of the piled papers.

Figure 3:
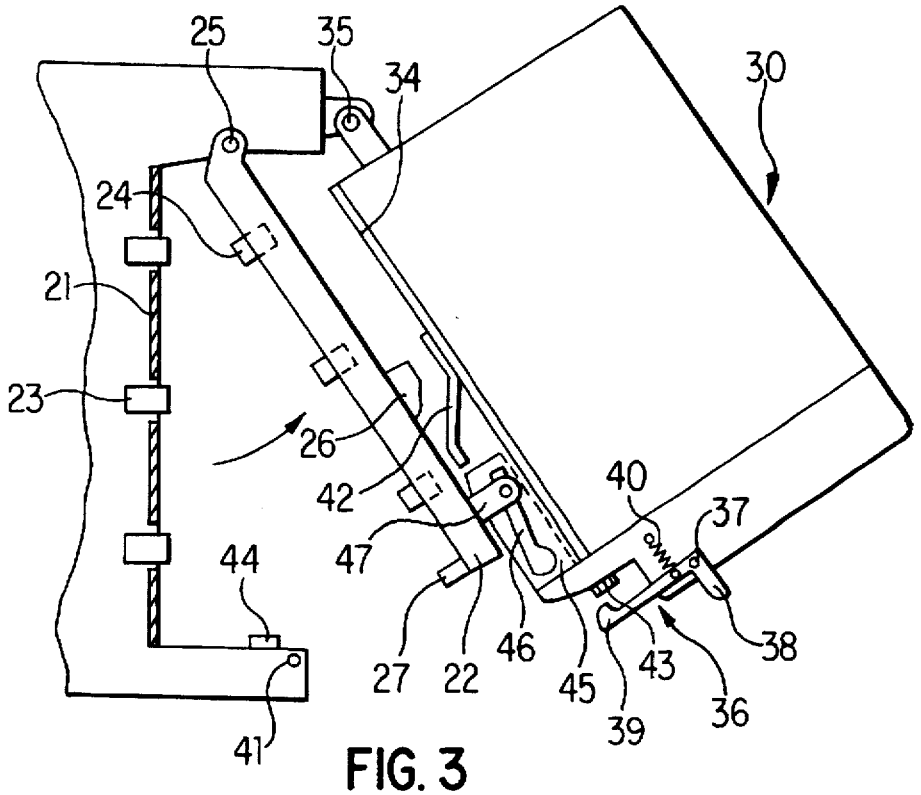
FIG. 3 is also a top view of the large capacity paper feeding unit and the movable guide at an open position.

The vertical paper feeding guide 21 is fixed to the main body 1 of the image forming apparatus and hereinafter is called a fixed guide 21 and the vertical paper feeding guide 22 is held for movement relative to the main body 1 on a shaft 25 and is hereinafter called a movable guide 22. The large capacity paper feeding unit 30 is also held to move relative to the main body 1 on a shaft 35. In this case, both of the shaft 25 of the movable guide 22 and the shaft 35 of the large capacity paper feeding unit 30 are parallel to the direction of feeding papers through the vertical paper path 20, and are mounted on the back side of the main body 1. Accordingly, both of the vertical paper guide 22 and the large capacity paper feeding unit 30 are able to swing to open and close at the front side of the main body 1 as shown in FIGS. 2 and 3.

A locking mechanism 36 is provided to the front side of the main body 1 to lock the unit 30 at a closed position. The locking mechanism 36 includes a lock lever 38 which has a hooking portion 39 on its tip, a spring 40 which exerts a pulling force to hook a hooking portion 39 to a lock pin 41 and a stopper (not shown) which keeps the lock lever 38 at a predetermined position against the spring 40. The lock lever 38 is held for rotation relative to a shaft 37 of the unit 30 and the lock pin 41, to which the hooking portion 39 of the lock lever 38 is engaged, is mounted on the main body 1.

A sheet spring 42 is provided as an elastic member on the control plate 34 of the unit 30 facing towards the movable guide 22, and the sheet spring 42 thrusts against a projecting portion 26 which is mounted on the movable guide 22 when the unit 30 is at the closed position. Further, the sheet spring 42 exerts a pressing force to press the movable guide 22 towards the fixed guide 21, that is, a rotating force in a clockwise direction around the shaft 25 as shown in FIG. 2. The movable guide 22 is provided with a spacer 27 mounted on the surface thereof facing towards the fixed guide 21 to maintain a predetermined distance from the fixed guide 21 when pressed towards the fixed guide 21.

Figure 4:
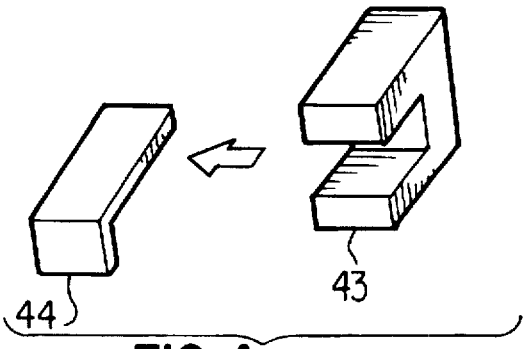
FIG. 4 is a perspective view showing a sensor device for detecting the large capacity paper feeding unit at the closed position.

A sensor device is included in the image forming apparatus of the present invention to sense if the large capacity paper feeding unit 30 is at the closed position. The sensor device includes a sensor 43 which may be a photo coupler and mounted on the large capacity paper feeding unit 30, and a light interrupting plate 44 which is mounted on the main body 1. The sensor 43 detects the large capacity paper feeding unit 30 when the light is interrupted by the plate 44 at the closed position as shown in FIG. 4.

When the large capacity paper feeding unit 30 is moved from the open position to the closed position, and if the lock lever 38 is not engaged properly to the lock pin 41, the sensor 43 detects that the unit 30 is not at the closed position and the operation of the apparatus is discontinued. However, the sensor 43 may sometimes recognize that the unit 30 is at the closed position even when the unit 30 is slightly out of the closed position. If a paper is then fed from the unit 30, a paper jam or other machine malfunction will take place.

In order to prevent such malfunctions, an elastic bouncing member, such as sheet spring 42, is provided between the movable guide 22 and the unit 30, so that it thrusts the unit 30 further away from the main body around the shaft 35 when the unit is not properly closed. For the bouncing elastic member, a suitable pressure spring may be employed. However, in this embodiment, sheet spring 42 is used as the bouncing elastic member. The sheet spring 42 thrusts the movable guide 22 towards the fixed guide 21 when the large capacity paper feeding unit 30 is locked. When unlocked, the sheet spring 42 moves the unit 30 away from the main body 1 around the shaft 35. In addition, when the lock is released, the sheet spring 42 thrusts the large capacity paper feeding unit 30 to such a position that the interrupting plate 44 does not interrupt sensing light of the sensor 43.

Accordingly, when the unit 30 is unlocked, the unit 30 is pushed back to such an open position, where the interrupting plate 44 is out of the sensing area of the sensor 43, thereby avoiding the problem that the unit 30 is in position where the sensor 43 recognizes as if the unit 30 is at the closed position even when the unit 30 is not in the closed position. Furthermore, the unit 30 swings open automatically by a bouncing force of the sheet spring 42 when the lock lever 38 of the large capacity paper feeding unit is released.

Figure 5:
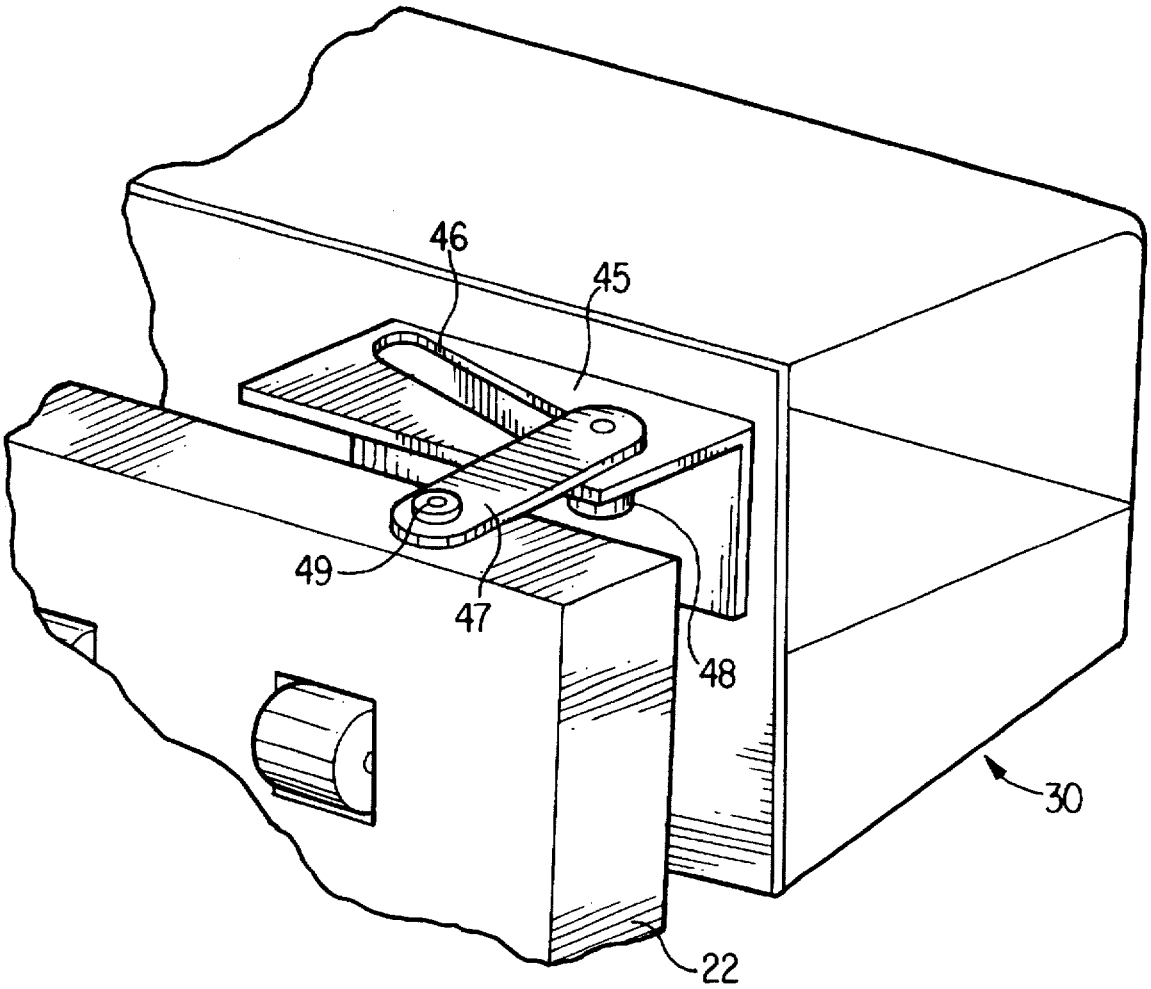
FIG. 5 is a perspective view showing a joint mechanism between the large capacity paper feeding unit and the movable guide.
Figure 6:
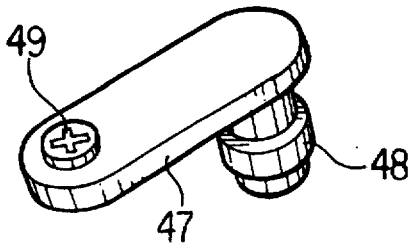
FIG. 6 is a perspective view showing connecting parts for the joint mechanism shown in FIG. 5.

In the large capacity paper feeding unit 30, a joint mechanism is provided for linking the unit 30 with the movable guide 22 on the upper part of the control plate 34, and on the opposite side of the shaft 35 as shown in FIG. 5. The joint mechanism includes a guide member 45 having a guide slit 46, which is attached to the large capacity paper feeding unit and a linking member 47 which is fixed to the movable guide 22 at one end and which slidably fits into the guide slit 46 with a cylinder part 48 which is provided at the other end as shown in FIGS. 5 and 6. The guide slit 46 is formed with an inclination to the control plate 34 such that each of the movable guide 22 and the unit 30 can maintain approximately the same opening angle towards the main body 1 and also keep a certain space between the movable guide 22 and unit 30.

With the joint mechanism, both of the movable guide 22 and the large capacity paper feeding unit 30 are able to open with a single operation on the unit 30, and also to always keep a suitable space between the movable guide 22 and the large capacity paper feeding unit 30 resulting in an advantage that the sheet spring 42 is not pressed unnecessary regardless of the open angle.

The cylinder part 48 is made of a material of reduced friction or the surface thereof is processed to be slippery so that both of the large capacity paper feeding unit 30 and the movable guide 22 are moved to close and open relative to the main body 1 with ease even after connected by the joint mechanism.

Figure 7:
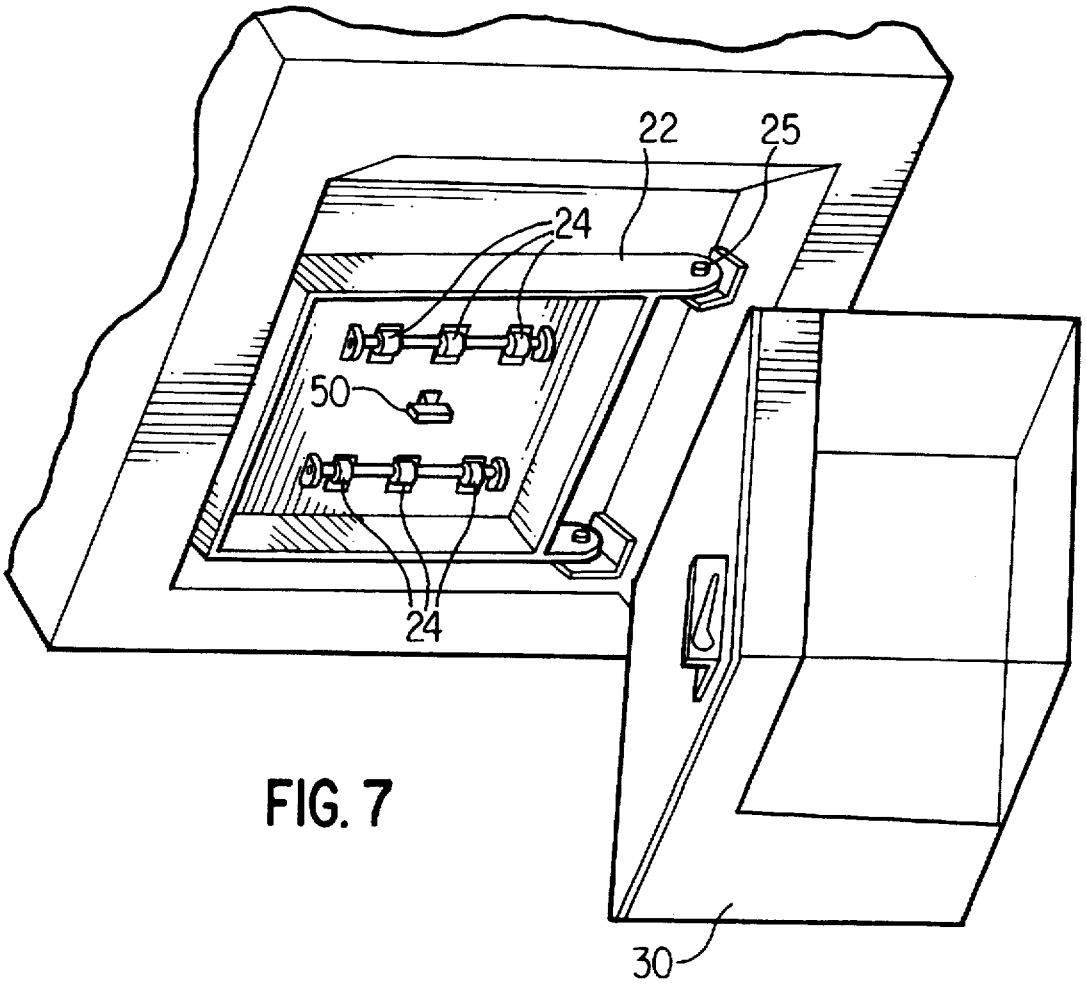
FIG. 7 is a perspective view showing the large capacity paper feeding unit and the movable guide, which are detached.

In addition, the linking member 47 is fixed to the movable guide 22 by such a detachable part as a screw 49 as shown in FIGS. 5 and 6. Therefore, the linking member 47 can be easily disconnected by detaching the screw 49, and the large capacity paper feeding unit 30 and the movable guide 22 can be separated easily as shown in FIG. 7, thereby facilitating access to a sensor 50, which is placed adjacent to the vertical paper path for paper jam detection and which may need to be adjusted and replaced regularly.

Further, since the large capacity paper feeding unit 30 and the movable guide 22 are made as separate units, even when the vertical paper path 20 of the apparatus is modified, only the movable guide 22 needs to be changed and the large capacity paper feeding unit 30 does not need to be changed, thus avoiding an unnecessary change on the part of the unit 30 which would occur in the case the unit 30 and the guide 22 were made integrally.

As described above, the image forming apparatus according to the present invention can provide such capabilities which largely facilitate improved operation of the apparatus, in compliance with customers demands, as: (1) paper feeding without skew of copy sheets, (2) use of a large capacity paper feeding unit with less modification in different models with different vertical paper path designs, (3) alerting operators for insufficient locking before causing paper jam or mis-feeding, (4) reduction of a number of machine parts, resulting in weight reduction of the apparatus and faster assembly, (5) easy operation, such as simultaneous opening of a paper feeding guide and a large capacity paper feeding unit for maintenance, and (6) each replacement of parts, such as a sensor.

Obviously, numerous modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An image forming apparatus comprising:

a main body and an image forming unit provided inside of the main body;

a plurality of paper stackers storing papers connected to the image forming unit;

a paper feeder feeding papers individually from the plurality of paper stackers;

a vertical paper path through which papers are transferred to the image forming unit from the plurality of paper stackers;

first and second vertical paper feeding guides, the first guide being fixed to the main body of the apparatus as a fixed guide, and the second guide including a first shaft being movably held to swing open and close relative to the main body as a movable guide around the first shaft provided at one end of the second guide in parallel to a direction of the vertical paper path; and a large capacity paper feeding unit provided adjacent to the vertical paper path, outside the main body including a second shaft, and movably held to swing open and close relative to said main body around the second shaft provided at one end of the large capacity paper feeding unit in parallel to the direction of the vertical paper path.

2. The image forming apparatus according to claim 1, further comprising:

an elastic element provided between said large capacity paper feeding unit and said movable guide for thrusting said movable guide towards said fixed guide; and a spacer provided between said movable guide and said fixed guide maintaining a predetermined distance between said movable guide and said fixed guide.

3. The image forming apparatus according to claim 1, further comprising:

a locking mechanism to lock said large capacity paper feeding unit at a closed position;

a sensor detecting said large capacity paper feeding unit at the closed position; and an elastic bouncing element provided between said large capacity paper feeding unit and said movable guide to move said large capacity paper feeding unit away from the main body around the second shaft to a position that said sensor does not detect said large capacity paper feeding unit.

4. The image forming apparatus according to claim 3, wherein said elastic bouncing element comprises a sheet spring member mounted on said large capacity paper feeding unit at a surface facing towards said movable guide.

5. The image forming apparatus according to claim 1, wherein said first shaft of said movable guide and said second shaft of said large capacity paper feeding unit are mounted on an end of a same side of the image forming apparatus, and further comprising a joint mechanism to connect said movable guide with said large capacity paper feeding unit such that said movable guide opens and closes relative to the main body in connection with said large capacity paper feeding unit, said joint mechanism holding said movable guide and the large capacity paper feeding unit approximately in a same open and close angle relative to the main body.

6. The image forming apparatus according to claim 5, further comprising:

an elastic element provided between said large capacity paper feeding unit and said movable guide for thrusting said movable guide towards said fixed guide; and a spacer provided between said movable guide and said fixed guide for maintaining a predetermined distance between said movable guide and said fixed guide.

7. The image forming apparatus according to claim 5, further comprising:

a locking mechanism to lock said large capacity paper feeding unit at a closed position;

a sensor detecting said large capacity paper feeding unit at the closed position; and an elastic bouncing element provided between said large capacity paper feeding unit and said movable guide to move said large capacity paper feeding unit away from the main body around the second shaft to a position that said sensor does not detect said large capacity paper feeding unit.

8. The image forming apparatus according to claim 7, wherein said elastic bouncing element comprises a sheet spring member mounted on said large capacity paper feeding unit at a surface facing towards said movable guide.

9. The image forming apparatus according to claim 5, wherein said joint mechanism connects said movable guide such that said movable guide is detachable from the large capacity paper feeding unit when the large capacity paper feeding unit is in an open position.

10. The image forming apparatus according to claim 5, wherein said joint mechanism includes a guide member having a guide slit and attached to the large capacity paper feeding unit and a linking member which is fixed to the movable guide at a first end and which slidably fits into the guide slit of the guide member with a cylinder part which is provided at a second end.

11. The image forming apparatus according to claim 10, wherein a surface of the cylinder part of said linking member is made slippery.

12. An image forming apparatus comprising:

a main body and an image forming means provided inside of the main body;

a plurality of paper stacker means for storing papers connected to the image forming means;

a paper feed means for feeding papers individually from the plurality of paper stacker means;

a vertical paper path through which papers are transferred to the image forming means from the plurality of paper stacker means;

first and second vertical paper feeding guide means, the first guide means being fixed to the main body of the apparatus as a fixed paper feeding guide means, and the second guide means including a first shaft and being movably held to swing open and close relative to the main body as a movable paper feeding guide mans around the first shaft provided at one end of the second guide means in parallel to a direction of the vertical paper path; and a large capacity paper feeding means provided adjacent to the vertical paper path, outside the main body including a second shaft, and movably held to swing open and close relative to said main body around the second shaft provided at one end of the large capacity paper feeding means in parallel to the direction of the vertical paper path.

13. The image forming apparatus according to claim 12, further comprising:

elastic means provided between said large capacity paper feeding means and said movable guide means for thrusting said movable guide means towards said fixed guide means; and a spacer means provided between said movable guide and said fixed-guide maintaining a predetermined distance between said movable guide means and said fixed guide means.

14. The image forming apparatus according to claim 12, further comprising:

a locking means for locking said large capacity paper feeding means at a closed position;

sensing means for detecting said large capacity paper feeding means at the closed position; and elastic bouncing means provided between said large capacity paper feeding means and said movable guide means to move said large capacity paper feeding means away from the main body around the second shaft to a position that said sensing means does not detect said large capacity paper feeding means.

15. The image forming apparatus according to claim 14, wherein said elastic bouncing means comprises a sheet spring member mounted on said large capacity paper feeding means at a surface facing towards said movable guide means.

16. The image forming apparatus according to claim 12, wherein said first shaft of said movable guide means and said second shaft of said large capacity paper feeding means are mounted on an end of a same side of the image forming apparatus, and further comprising a joint means to connect said movable guide means with said large capacity paper feeding means such that said movable guide means opens and closes relative to the main body in connection with said large capacity paper feeding means, said joint means holding said movable guide means and the large capacity paper feeding means approximately in a same open and close angle relative to the main body.

17. The image forming apparatus according to claim 14, wherein said first shaft of said movable guide means and said second shaft of said large capacity paper feeding means are mounted on an end of a same side of the image forming apparatus, and further comprising a joint means to connect said movable guide means with said large capacity paper feeding means such that said movable guide means opens and closes relative to the main body in connection with said large capacity paper feeding means, said joint means holding said movable guide means and the large capacity paper feeding means approximately in a same open and close angle relative to the main body.

18. The image forming apparatus according to claim 16, wherein said joint means connects said movable guide means such that said movable guide means is detachable from the large capacity paper feeding means when the large capacity paper feeding means is in an open position.

19. The imager forming apparatus according to claim 16, wherein said joint means includes a guiding means having a guide slit and attached to the large capacity paper feeding means and a linking means which is fixed to the movable guide means at a first end and which slidably fits into the guide slit of the guiding means with a cylinder part which is provided at a second end.

20. The image forming apparatus according to claim 19, wherein a surface of the cylinder part of said linking means is made slippery.

* * * * *